US005201191A

United States Patent [19]

Bustos

[11] Patent Number: 5,201,191

[45] Date of Patent: Apr. 13, 1993

[54] REFRIGERATED MERCHANDISER

[76] Inventor: Rafael T. Bustos, 1305 St. Lawrence Dr., Alpharetta, Ga. 30202

[73] Assignee: Leggett & Platt, Inc., Carthage, Mo.

[21] Appl. No.: 755,664

[22] Filed: Sep. 6, 1991

[51] Int. Cl.[5] ..... A47F 3/04

[52] U.S. Cl. ..... 62/249; 62/252; 211/187; 211/189

[58] Field of Search ..... 62/246, 249, 251, 252; 108/59, 152; 211/187, 189; 312/236

[56] References Cited

U.S. PATENT DOCUMENTS

| | | | |
|---|---|---|---|
| 1,959,926 | 5/1933 | Reich | 62/250 |
| 1,967,058 | 7/1934 | Longstreth | 62/251 X |
| 2,298,790 | 10/1942 | Klassen | 62/249 X |
| 2,499,088 | 2/1950 | Brill et al. | 62/255 |
| 2,528,916 | 11/1950 | Shreve | 62/250 |
| 2,671,001 | 3/1954 | Ossana, Jr. | 62/250 |
| 2,836,039 | 5/1958 | Weber | 62/251 |
| 2,852,327 | 9/1958 | Mason | 312/45 |
| 3,010,290 | 11/1961 | Fredrick | 62/251 |
| 3,203,197 | 8/1965 | Zaslovsky et al. | 62/277 |
| 3,263,745 | 8/1966 | Henry | 165/48 |
| 3,675,440 | 7/1972 | Ibrahim | 62/256 |
| 4,373,355 | 2/1983 | Monroe | 62/256 |
| 4,508,231 | 4/1985 | Honickman | 211/189 X |
| 4,663,943 | 5/1987 | Dyment et al. | 62/250 |
| 4,676,074 | 6/1987 | Morgan, Jr. et al. | 62/277 |
| 4,697,712 | 10/1987 | Valiulis | 211/187 |
| 4,794,764 | 1/1989 | Dyment et al. | 62/250 |

FOREIGN PATENT DOCUMENTS 1159022 6/1958 France .

*Primary Examiner*—William E. Tapolcai
*Attorney, Agent or Firm*—Wood, Herron & Evans

[57] ABSTRACT

A combined refrigerated merchandiser comprises a pair of upright support panels, a merchandising refrigerator spanning between the upright support panels for refrigerating and displaying soft drinks and the like, and non-refrigerated shelves spanning between the upright support panels for merchandising and displaying non-refrigerated snack items and the like. In one embodiment, the refrigerator is located in a lowermost position and is of the chest-type, while the shelves are located in an uppermost position and comprise a plurality of display rack shelves. In another embodiment, the refrigerator is located in an uppermost position and is of the gravity feed dispenser type, while the shelves are located in a lowermost position.

14 Claims, 5 Drawing Sheets

REFRIGERATED MERCHANDISER

FIELD OF THE INVENTION

This invention relates to merchandising, and more particularly to point-of-purchase displays for simultaneously merchandising refrigerated and non-refrigerated consumer products.

BACKGROUND OF THE INVENTION

Merchandising displays, and more particularly point-of-purchase displays, are well known for retailing products. Such merchandising displays or racks are also well known for use adjacent check-out counters of grocery stores, supermarkets and the like for the display and merchandising of beverages and snack items. The items displayed thereon are either of the variety which requires no refrigeration, for example, snack items, or if the display is utilized to display beverages thereon, the beverages are simply not refrigerated.

Another type of merchandising display includes means for refrigerating the products displayed therein. Such refrigerated displays or so-called showcases have taken many forms, some of which include chest-type open refrigerators, and upright refrigerators or cooling cases having a series of shelves therein and either an open front or a glass covered front for displaying products therein. Such showcases are useful for displaying, for example, beverages, dairy products, and various types of frozen foods.

It would be desirable to provide a point-of-purchase display wherein individual refrigerated containers of soft drinks or the like, whether in cans or in bottles, could be merchandised in close proximity to snack items and the like which require no refrigeration. Such a display would be particularly useful in grocery stores or supermarkets positioned adjacent the check-out counters.

It has therefore been an objective of this invention to provide a combined refrigerated and non-refrigerated merchandiser which allows for merchandising and displaying in point-of-purchase fashion both refrigerated items, and non-refrigerated items.

SUMMARY OF THE INVENTION

To accomplish this objective, a combined refrigerated merchandiser is provided which comprises a pair of upright support panels, a merchandising refrigerator spanning between the upright support panels for refrigerating and displaying soft drinks and the like, and non-refrigerated shelves spanning between the upright support panels for merchandising and displaying non-refrigerated snack items and the like.

In one embodiment, the refrigerator is located in a lowermost position between the support panels and is of the chest-type, while the shelves are located in an uppermost position above the refrigerator and comprise a plurality of display rack shelves removably secured to the support panels.

In another embodiment, the refrigerator is located in an uppermost position between the support panels and is of the gravity feed dispenser type, while the shelves are located in a lowermost position beneath the refrigerator and comprise a plurality of display rack shelves removably secured to the support panels.

The combined refrigerated merchandiser of the present invention further includes merchandising non-refrigerated cantilevered shelves removably secured to the upright support panels on their outboard sides.

One advantage of the present invention is that a combined refrigerated merchandiser has been provided which allows for merchandising and displaying for point-of-purchase both refrigerated items and non-refrigerated items.

Another advantage of the present invention is that a combined refrigerated merchandiser has been provided which is adaptable to meet the specific needs of the grocer or retailer.

These and other objects and advantages of the present invention will become more readily apparent to those skilled in the art during the following detailed description taken in conjunction with the drawings herein, in which:

DESCRIPTION OF PREFERRED EMBODIMENTS

Figure 1:
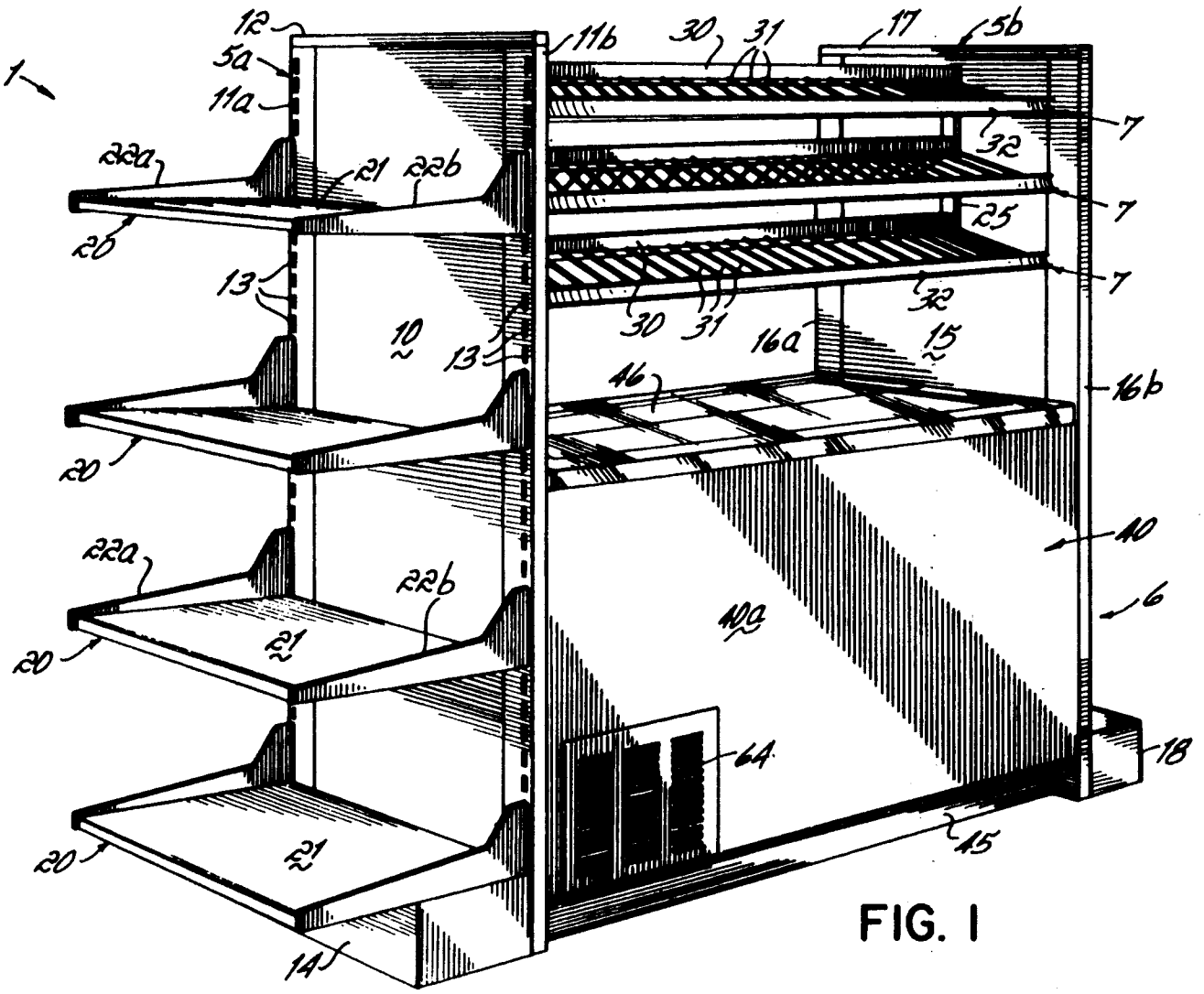
FIG. 1 is a perspective view of one embodiment of the combined refrigerated merchandiser of the present invention.
Figure 2:
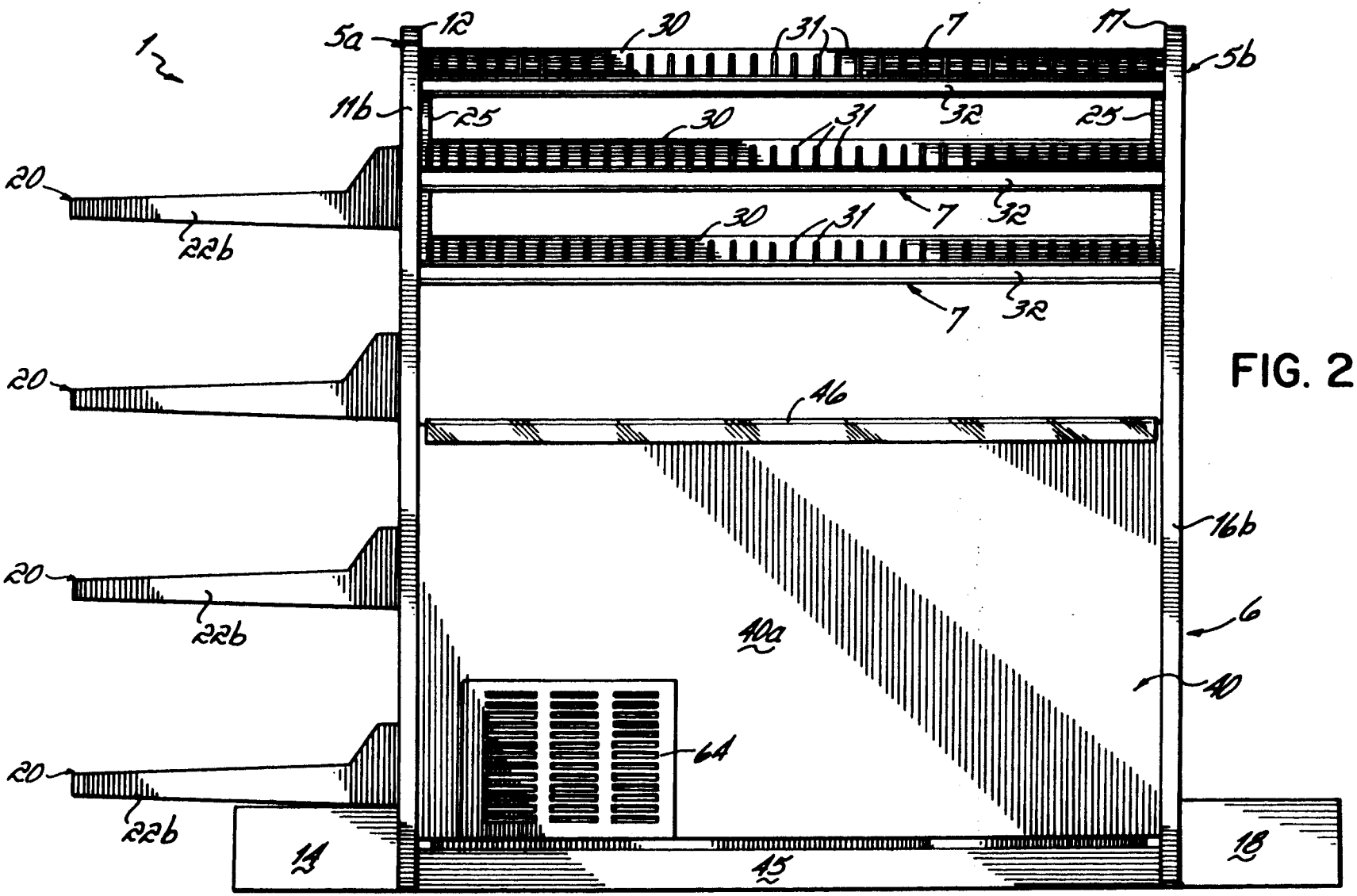
FIG. 2 is a front view of the merchandiser of FIG. 1.
Figure 3:
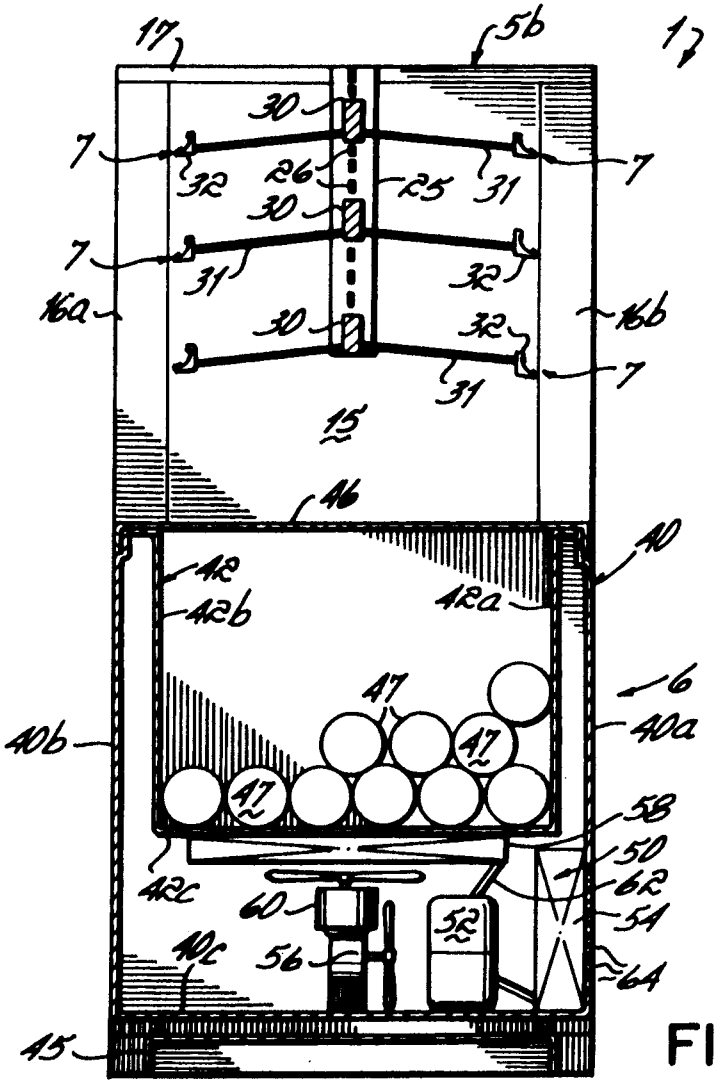
FIG. 3 is a cross-sectional view of the merchandiser of FIG. 1.

With reference first to FIGS. 1-3, there is illustrated one embodiment of the combined refrigerated merchandiser 1 of the present invention. The merchandiser 1 comprises upright support panels 5*a* and 5*b*, a merchandiser refrigerator 6 spanning between the upright support panels 5*a* and 5*b* for refrigerating and displaying soft drinks and the like, and merchandising non-refrigerated shelves 7 spanning between the upright support panels 5*a* and 5*b* for displaying non-refrigerated snack items and the like. In this embodiment, the refrigerator 6 is located in a lowermost position, and the non-refrigerated shelves 7 are located in an uppermost position. Furthermore, this refrigerator 6 is of the chest type.

The upright support panel 5*a* comprises a sheet metal panel 10, corner posts 11*a* and 11*b* secured to each side edge of the panel 10, and a top support 12 similarly secured to the panel 10. The corner posts 11*a* and 11*b* include a plurality of vertically aligned and spaced slots 13. A foot 14 is secured to the lowermost ends of the corner posts 11*a* and 11*b*, and panel 10. Similarly, upright support panel 5*b* comprises a panel 15, corner posts 16*a* and 16*b* secured on either side thereof, a top support 17 secured to an upper edge thereof, and a foot 18 secured to a lower edge thereof. The corner posts 16*a* and 16*b* similarly have vertically aligned and spaced slots formed therein (not shown).

The slots 13 in the corner posts 11*a*, 11 *b* and 16*a*, 16*b* may be employed to removably secure thereto a plurality of cantilevered shelves 20. The shelves 20 each comprise a shelf surface 21, and a pair of cantilever support arms 22*a* and 22*b* secured to either side of the shelf surface 21. The support arms 22*a* and 22*b* include on their rear ends conventional tangs (not shown) which engage the slots 13 for removably securing the shelf to the support panel 10.

With reference now to FIG. 3, it will be seen that each upright support panel 5a and 5b includes a centerpost 25 which includes a plurality of slots 26 therealong. These centerposts 25 with slots 26 therein are utilized to hang a plurality of shelves 7 thereon. Each shelf 7 comprises a spine 30 which includes on its ends tangs (not shown) for engaging the slots 26 in the centerpost 25. A wire grid 31 is cantilevered outwardly and downwardly from the spine 30 and forms a lightweight shelf surface for displaying non-refrigerated product thereon. A label holder 32 is attached to a forward edge of the wire grid 31 for displaying labels of the product displayed thereon.

Describing now the refrigerator 6 with more particularity, this refrigerator 6 comprises an outer box 40 and an inner box 42. The outer box 40 includes side walls 40a and 40b, bottom 40c, and two end walls, one of which is shown at 40d. The inner box 42 includes side walls 42a and 42b, bottom 42c, and two end walls, one of which is shown at 42d. A floor contacting base 45 supports the outer box 40 above the floor surface. A transparent cover 46 covers the inner box 42 to maintain refrigeration therein, and allows visibility of and easy access to beverages 47 displayed therein.

The refrigerator 6 includes a refrigeration system 50 for cooling the beverages 47 in the inner box 42. The refrigeration system 50 is of conventional variety and is mounted on the floor 40c of the outer box 40. The refrigeration system 50 comprises a compressor 52, a condenser 54, a condenser fan 56, an evaporator 58 and an evaporator fan 60. Standard refrigerant flows in the refrigeration loop 62. A grate 64 is provided in the lower corner of the side 40a of outer box 40 to exhaust hot air out of the outer box 40.

Figure 6:
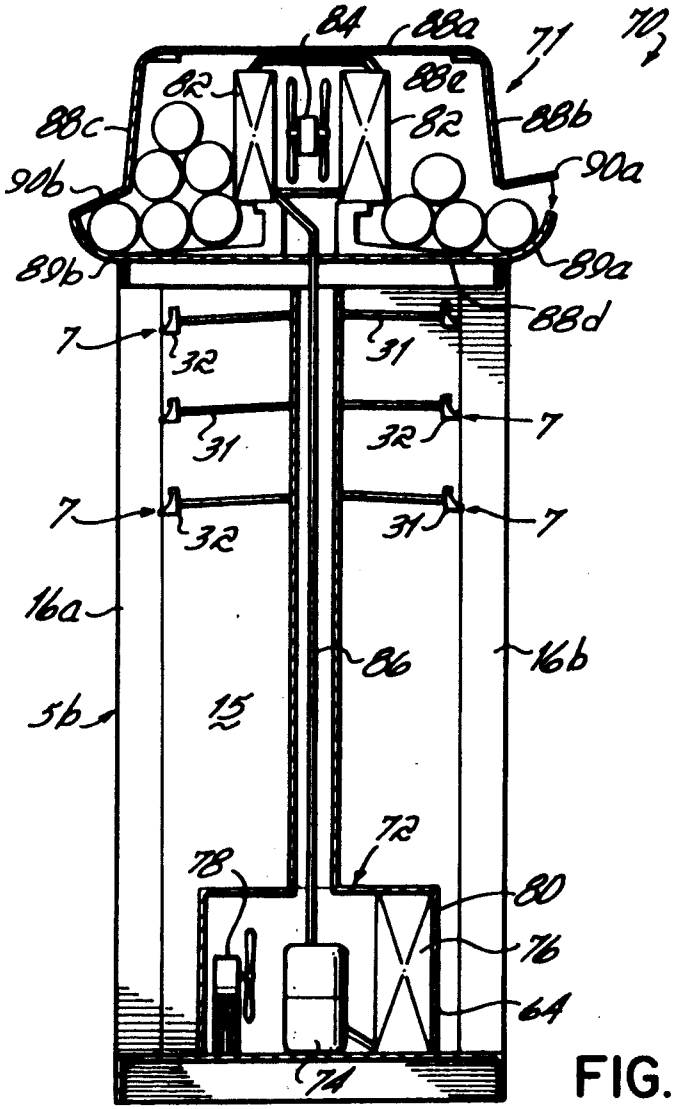
FIG. 6 is a cross-sectional view of the merchandiser of FIG. 4.
Figure 4:
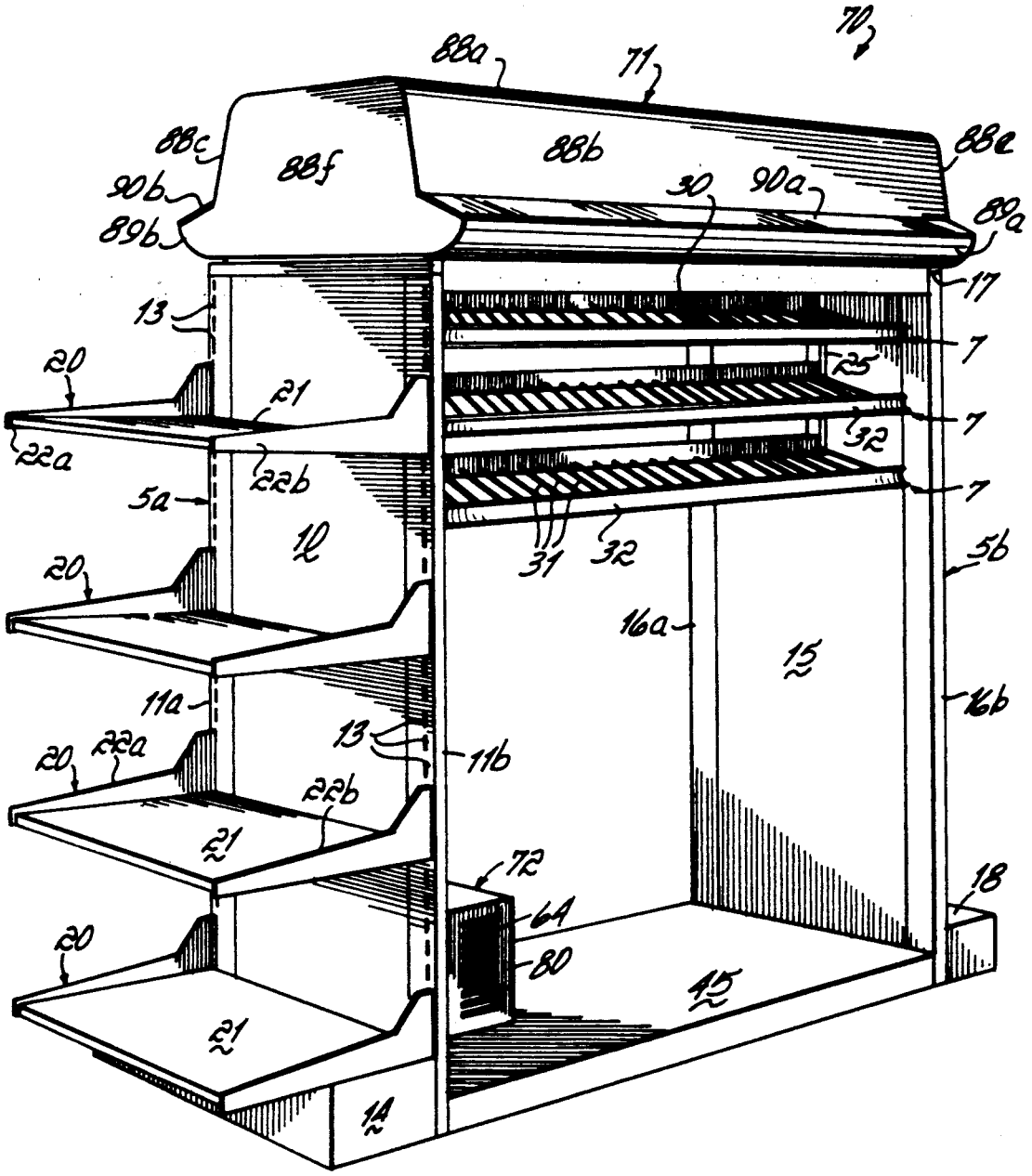
FIG. 4 is a perspective view of another embodiment of the combined refrigerated merchandiser of the present invention.
Figure 5:
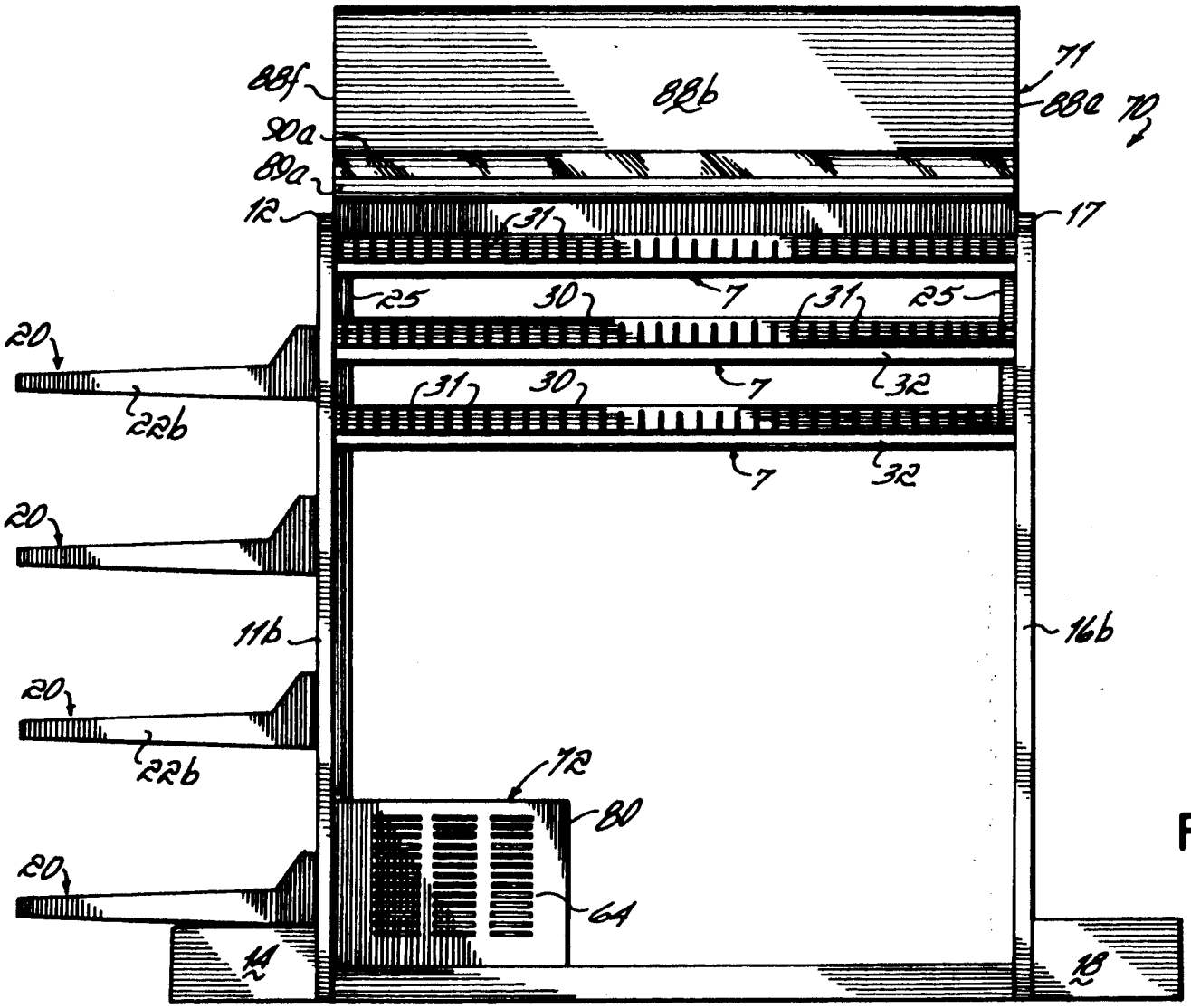
FIG. 5 is a front view of the merchandiser of FIG. 4.

With reference now to FIGS. 4–6, there will be seen an alternative embodiment refrigerated merchandiser 70. With like numbers designating like components, the merchandiser 70 comprises upright support panels 5a and 5b, a refrigerator 71 and shelves 7. In this embodiment, the refrigerator 71 is located in an uppermost position, and the non-refrigerated shelves 7 are located in a lowermost position. Furthermore, the refrigerator 71 of this embodiment is of the gravity feed dispenser type. The refrigerator 71 includes a refrigeration system 72 which comprises a compressor 74, a condenser 76 and a condenser fan 78 housed within a sheet metal box 80 mounted atop the base 45. Twin evaporators 82 and evaporator fans 84 are housed within a refrigerator hood 88. A refrigeration line 86 supplies standard refrigerant to the system.

The refrigeration hood 88 includes a top 88a, sides 88b and 88c, a bottom 88d and two end walls 88e and 88f. Additionally, the hood 88 includes dual dispensers 89a and 89b located at the lower edges of the sides 88b and 88c for dispensing beverages 47 therein. The dispensers 89a and 89b are covered with transparent covers 90a and 90b which pivot at their inwardmost edges which allow visualization of and easy access to the product 47 therein. Product 47 is loaded into the hood 88 via access through the top 88a, and feeds downwardly and outwardly to the dispensers 89a and 89b via gravity.

In use, the refrigerated merchandiser of the present invention can be employed in numerous ways by a merchant for merchandising product. For example, and referring to the embodiment of FIGS. 1–3, bottles or cans of soft drink or the like may be conveniently refrigerated and displayed in the refrigerator 6, while non-refrigerated product such as candy or the like may be displayed on the shelf 7. The shelves 20 may be employed for displaying such snack items as chips or the like, or alternatively could be employed to display unrefrigerated containers of soft drink in standard two liter containers. Referring to the embodiment of the refrigerated merchandiser of FIGS. 4–6, soft drinks or the like are conveniently refrigerated and displayed for purchase in the refrigerated hood 88 while non-refrigerated snack items such as candy and the like are displayed for sale on the shelf 7. As in the embodiment of FIGS. 1–3, non-refrigerated snack items such as chips or the like, or larger containers of soft drink, such as the two liter bottle variety, may be stored on the cantilevered shelves 20. Furthermore, six packs, twelve packs or twenty-four count cases may be stacked atop the base 45 for merchandising same thereon.

The merchandisers described hereinabove are particularly suited and intended for use in grocery stores and supermarkets where the merchandisers are to be positioned adjacent check-out counters. Thus, these merchandisers will enhance sales of displayed refrigerated products without sacrificing sales of non-refrigerated products.

Those skilled in the art will readily recognize adaptations and modifications which can be made to the present invention which will result in an improved refrigerated merchandiser yet without departing from the spirit or scope of the invention as defined in the appended claims. Accordingly, I intend to be limited only by the following claims.

What is claimed is:

1. A combined refrigerated merchandiser comprising:

A front side and a rear side, a pair of spaced apart generally rectangular upright support panels, each having a widthwise dimension, a merchandising refrigerator spanning between said upright support panels for refrigerating and displaying soft drinks and the like, said merchandising refrigerator having a depth dimension generally parallel to said widthwise dimension of said support panels which is substantially equal to said widthwise dimension of said support panels, non-refrigerated shelves spanning between said upright support panels for displaying and merchandising non-refrigerated snack items and the like, said non-refrigerated shelves having a depth dimension generally parallel to said widthwise dimension of said support panels which is substantially equal to said widthwise dimension of said support panels, both said front side and said rear side of said merchandiser being generally open and unobstructed in the general vicinity of said support shelves to allow a customer to access both refrigerated soft drinks and non-refrigerated snack items from either side of said combined refrigerated merchandiser.

2. The combined refrigerated merchandiser of claim 1 wherein said refrigerator is located in a lowermost position between said support panels, and said non-refrigerated shelves are located in an uppermost location above said refrigerator.

3. The combined refrigerated merchandiser of claim 1 wherein said refrigerator is located in an uppermost position between said support panels, and said non-refrigerated shelves are located in a lowermost location beneath said refrigerator.

4. The combined refrigerated merchandiser of claim 2 wherein said refrigerator is of the chest-type.

5. The combined refrigerated merchandiser of claim 3 wherein said refrigerator is of the gravity feed dispenser-type.

6. The combined refrigerated merchandiser of claim 2 wherein said non-refrigerated shelves comprise a plurality of display rack shelves removably secured to said upright support panels.

7. The combined refrigerated merchandiser of claim 3 wherein said non-refrigerated shelves comprise a plurality of display rack shelves removably secured to said upright support panels.

8. The combined refrigerated merchandiser of claim 1 further including merchandising non-refrigerated cantilevered shelves removably secured to said upright support panels on outboard sides thereof.

9. A combined refrigerated merchandiser comprising:

a pair of spaced apart generally rectangular upright support panels, each having a widthwise dimension, a merchandising refrigerator spanning between said upright support panels for refrigerating and displaying soft drinks and the like, said merchandising refrigerator having a depth dimension generally parallel to said widthwise dimension of said support panels which is substantially equal to said widthwise dimension of said panels, said refrigerator being located in a lowermost location and being of the chest-type, non-refrigerated shelves spanning between said upright support panels for merchandising and displaying non-refrigerated snack items and the like, said non-refrigerated shelves having a depth dimension generally parallel to said widthwise dimension of said support panels which is substantially equal to said widthwise dimension of said support panels, said shelves being located in an uppermost location and comprising a plurality of shelves removably secured to said upright support panels above said refrigerator and being downwardly and forwardly tilted toward either side of said merchandiser, and merchandising non-refrigerated cantilevered shelves removably secured to said upright support panels on outboard sides thereof, whereby a customer can access both refrigerated soft drinks and non-refrigerated snack items from either side or end of said combined refrigerated merchandiser.

10. A combined refrigerated merchandiser comprising:

a pair of spaced apart upright support panels, a merchandising refrigerator spanning between said upright support panels for refrigerating and displaying soft drinks and the like, said refrigerator being located in a lowermost location and being of the chest type, and non-refrigerated shelves spanning between said upright support panels for merchandising and displaying non-refrigerated snack items and the like, said shelves being located in an uppermost location and comprising a plurality of shelves removably secured to said upright support panels above said refrigerator and being downwardly and forwardly tilted toward either side of said merchandiser, whereby a customer can access both refrigerated soft drinks and non-refrigerated snack items from either side of said combined refrigerated merchandiser.

11. A combined refrigerated merchandiser comprising:

a pair of spaced apart generally rectangular upright support panels, each having a widthwise dimension, a merchandising refrigerator spanning between said upright support panels for refrigerating and displaying soft drinks and the like, said merchandising refrigerator having a depth dimension generally parallel to said widthwise dimension of said support panels which is substantially equal to said widthwise dimension of said support panels, non-refrigerated shelves spanning between said upright support panels for displaying and merchandising non-refrigerated snack items and the like, said non-refrigerated shelves having a depth dimension generally parallel to said widthwise dimension of said support panels which is substantially equal to said widthwise dimension of said support panels, said non-refrigerated shelves being completely open and unobstructed, whereby a customer can access both refrigerated soft drinks and non-refrigerated snack items either side of said combined refrigerated merchandiser.

12. A combined refrigerated merchandiser comprising:

a pair of spaced apart generally rectangular upright support panels, each having a widthwise dimension, a merchandising refrigerator spanning between said upright support panels for refrigerating and displaying soft drinks and the like, said merchandising refrigerator having a depth dimension generally parallel to said widthwise dimension of said support panels which is substantially equal to said widthwise dimension of said panels, said refrigerator being located in a lower most location and being of the chest-type, non-refrigerated shelves spanning between said upright support panels for merchandising and displaying non-refrigerated snack items and the like, said non-refrigerated shelves having a depth dimension generally parallel to said widthwise dimension of said support panels which is substantially equal to said widthwise dimension of said support panels, said non-refrigerated shelves being completely open and unobstructed, said shelves being located in an uppermost location and comprising a plurality of shelves removably secured to said upright support panels above said refrigerator and being downwardly and forwardly tilted toward either side of said merchandiser, and merchandising non-refrigerated cantilevered shelves removably secured to said upright support panels on outboard sides thereof, whereby a customer can access both refrigerated soft drinks and non-refrigerated snack items from either side or end of said combined refrigerated merchandiser.

13. A combined refrigerated merchandiser comprising:

a pair of spaced apart upright support panels, a front side and a rear side a merchandising refrigerator spanning between said upright support panels for refrigerating and displaying soft drinks and the like, and non-refrigerated shelves spanning between said upright support panels for displaying and merchandising snack items and the like;

said merchandising refrigerator and said non-refrigerated shelves having substantially equal depth dimensions which are generally transverse to a heightwise dimension of said support panels, both said front side and said rear side of said merchandising refrigerator being generally open and unobstructed in the general vicinity of said non-refrigerated shelves to allow a customer to access both refrigerated soft drinks and non-refrigerated snack items from either side of said combined refrigerated merchandiser.

14. A combined refrigerated merchandiser comprising:

a pair of spaced apart upright support panels, a merchandising refrigerator spanning between said upright support panels for refrigerating and displaying soft drinks and the like, said refrigerator being located in a lowermost location and being of the chest type, non-refrigerated shelves spanning between said upright support panels for merchandising and displaying non-refrigerated snack items and the like, said shelves being located in an uppermost location and comprising a plurality of shelves removably secured to said upright support panels above said refrigerator and being downwardly and forwardly tilted toward either side of said merchandiser, and merchandising non-refrigerated cantilevered shelves removably secured to said upright support panels on outboard sides thereof, said merchandising refrigerator and said non-refrigerated shelves having substantially equal depth dimensions which are generally transverse to a heightwise dimension of said support panels, whereby a customer can access both refrigerated soft drinks and non-refrigerated snack items from either side of said combined refrigerated merchandiser.

* * * * *